United States Patent [19]

Sudmann

[11] Patent Number: 4,715,072

[45] Date of Patent: Dec. 29, 1987

[54] SHOWER BARRIER

[76] Inventor: Jurgen-Peter Sudmann, Dietrich-Bonhoeffer-Str. 18, 2902 Rastede 1, Fed. Rep. of Germany

[21] Appl. No.: 840,517

[22] Filed: Mar. 17, 1986

[30] Foreign Application Priority Data

Mar. 18, 1985 [DE] Fed. Rep. of Germany ..... 3509683

[51] Int. Cl.[4] ..... A47K 3/22

[52] U.S. Cl. ..... 4/607

[58] Field of Search ..... 4/607, 608, 609, 610, 4/614; 160/231 A, 210, DIG. 6; 49/501, 488, 489; 16/253, 270, 260–262

[56] References Cited

U.S. PATENT DOCUMENTS

| | | | |
|---|---|---|---|
| 1,238,646 | 8/1917 | Dennis | 4/607 |
| 1,944,440 | 1/1934 | Lehman | 4/607 |
| 2,126,127 | 8/1938 | Mitchell | 16/371 |
| 3,901,302 | 8/1975 | Dagenais | 16/263 |
| 4,255,902 | 3/1981 | Ruff | 49/489 |
| 4,438,605 | 3/1984 | De Lucia | 160/231 A |
| 4,491,990 | 1/1985 | Robinson et al. | 4/610 |

FOREIGN PATENT DOCUMENTS

| | | | |
|---|---|---|---|
| 2911728 | 9/1980 | Fed. Rep. of Germany | 4/610 |
| 3310139 | 9/1984 | Fed. Rep. of Germany | 4/610 |
| WO84/3030 | 8/1984 | PCT Int'l Appl. | 4/610 |
| 2160257 | 12/1985 | United Kingdom | 16/262 |

*Primary Examiner*—Henry J. Recla
*Assistant Examiner*—L. J. Peters
*Attorney, Agent, or Firm*—Collard, Roe & Galgano

[57] ABSTRACT

A shower barrier is provided having one or a plurality of substantially rectangular wall sections each being limited by a frame formed by profiled rods and a plane splash water protection arranged on the frame. A plurality of lateral edges of the frame is formed in a single piece from a single profiled rod and adjacent wall sections are connected with each other by means of joints. In preferred embodiments of the frames, a closed frame is formed by a single suitably bent profiled rod, or three lateral edges of the frame are formed by a single U-shaped profiled rod. The free ends of the U-shaped profiled rod being connected by means of a straight cross strip. Each profiled rod may be a round tube.

14 Claims, 15 Drawing Figures

SHOWER BARRIER

The present invention relates to a shower barrier comprising one or a plurality of substantially rectangular wall sections, of which each wall section is limited by a frame formed by profiled rods, with a plane splash water protection being arranged on said frame.

Shower barriers are adapted to separate the bathtub or shower tub completely or partially from the rest of the bathroom. Such barriers screen off the splash water which, without the shower barrier, would splash over the floor of the bathroom over the edge of the tub. With the use of such shower barriers, the splash water runs down the shower separation and into the tub. Shower barriers of this type thus effectively ensure that the floor of the bathroom remains dry while a shower is being taken.

Known shower barriers normally comprise a frame made of extruded aluminum profiles in which plastic panels are fitted. The stability of the frames substantially depends upon the thickness of the aluminum profiles and on the interconnection of the aluminum profiles in the corners of the frame, for example by means of miter cuts and screw connections. Apart from the stability of such a shower barrier the price of the shower barrier depends basically on the quality of the aluminum profiles, i.e., on the quality of the material and the quality of the finish of their relatively complicated profile structure. In addition, with known shower barriers, the manufacture of the frames and the fitting of the plastic panels require relatively costly and labor intensive assembly work.

The object of the present invention is to provide a stable shower barrier that can be produced at favorable cost.

According to the present invention, this object is accomplished by forming several lateral edges of a shower barrier frame in one piece from a profiled rod.

Preferably, the frame of the shower barrier according to the present invention consists not of extruded aluminum profiles, but of, for example, steel rods with a simple cross section, which steel rods may be chrome-plated, for example, for protection against corrosion, or covered with a plastic material, so that the frames may be advantageously produced at favorable cost.

The one-piece profiled rod forming a plurality of the lateral edges of the frame may consist of, for example steel rods which are joined with each other at the corners of the frame by welding. In this way, the use of corner-connecting elements becomes largely superfluous in the manufacture of the frames and the frames are advantageously produced with such inherent stability that the splash water protection no longer participates in reinforcement and stability, so that the splash water protection may also have the simplest design.

According to a further object of the present invention, a closed frame is formed from a single suitably shaped profiled rod. The frame so formed is especially stable at its corners, which are formed by the bending radii of the profiled rod. The frame can be produced in an advantageous manner quickly and at favorable cost. Preferably, the two ends of the profiled rod forming the frame are welded together or otherwise connected with each other in order to advantageously increase the stability of the frame further.

In a preferred embodiment, the three lateral edges of the frame are formed by one single U-shaped profiled rod. Preferably, the U-shaped profiled rod forms the approximately vertical lateral edges of a frame as well as the top, transversely extending lateral edge of the frame, so that the frame has no bending radii within its bottom corner zones, and other wall sections disposed adjacent the frame may be joined closely with the frame without creating any intermediate corner space within the bottom zone of two adjacent wall sections that would require costly efforts to seal.

According to another object of the present invention, the free ends of the U-shaped profiled rod are interconnected by means of a straight cross strip. Advantageously, this cross strip serves to further stabilize the frame and seal the frame at its bottom zone, for example against the edge of the tub.

According to yet another object of the present invention, each profiled rod is a tube and preferably a round tube. The utilization of tubes as profiled rods effects advantageous material savings, permitting both a low-cost manufacture of the shower barrier according to the invention and a lighter (in terms of weight) construction of the shower barrier, which, in turn, permits a simpler installation.

According to a still further object of the present invention, adjacent lateral edges of the wall sections of the shower barrier have folding joints connecting these wall sections, and the end wall section has joint connectors provided on its free lateral edge for mounting the section on support elements provided on the side of the building. Advantageously, the shower barrier of the present invention can be folded together by means of the folding joints. Furthermore, the shower barrier is not mounted rigidly on the edge of the tub, but rather it is fastened on support elements on the building side, e.g. on the walls of brickwork, by means of joint connectors, for example by means of dowel pins. The joint connectors permit folding the shower barrier against the support elements provided on the building side. The shower barrier thus needs to remain unfolded only for the duration of a shower and may then be folded up again against the wall of the bathroom. This is advantageous especially when the shower barrier is used for a bathtub which is to be freely accessible, for example when a full bath is taken.

According to yet another object of the present invention, the splash water protection is a plastic board supported on the frame by means of holding elements. Preferably, the plastic board is detachably connected to the frame by means of holding or fastening elements, whereby the fastening elements may be rigidly connected with the plastic board or the frame.

According to yet another embodiment of the shower barrier of the present invention, the plastic board is fitted in the frame, so that the plastic board advantageously fully and completely covers the inner area defined by the frame, effectively preventing water from splashing through the frame.

According to another object of the present invention, holding elements are arranged on each plastic board, the elements gripping around the profiled rods. Preferably, the holding elements are also made of plastic material and shaped or molded on the plastic board so that the plastic board can be advantageously simply inserted in the frame. For example, the holding elements may be sleeve segments made of plastic material which grip around more than half of the circumference of the profiled rods. The plastic sleeve segments, because of the flexibility of the plastic material, may be pressed over the profiled rods to firmly clamp around the profiled rods.

According to yet another object of the present invention, the holding elements are sleeve pieces gripping around the profiled rods, wherein each piece has approximately radially protruding, outer fish plates receiving between each other a marginal zone of the plastic board. For example, the profiled rods having sleeve pieces with outer fish plates may be covered, and said sleeve pieces are preferably made of plastic material. The plastic board is fitted or inserted between the outer fish plates of the sleeve pieces, so that the intermediate space between the edges of the plastic board and the profiled rods is advantageously completely covered and sealed by said outer fish plates.

In a preferred embodiment of the shower barrier according to the present invention, the surfaces of the outer fish plates which face each other have sealing elements, preferably sealing elements molded on said fish plates, which advantageously effect additional sealing between the outer fish plates and the marginal zones of the plastic board which is inserted or fitted between said fish plates, as well as ensure a shock-absorbing support for the plastic board.

According to yet another preferred embodiment of the present invention, each sleeve piece consists of two plastic semi-cups connected with each other by means of a joint, preferably by a per-se-known weakening joint, whereby the free ends of the semi-cups which are averted from the joint have connecting elements capable of being arrested with each other. These sleeve pieces, advantageously, may be folded open and removed from the profiled rods, so that the plastic board can be removed from the frame and, for example, replaced when damaged.

Since the splash water protection does not participate in the stiffening and stability of the wall section, it may be produced in a very simple and low-cost manner. The splash water protection may be, for example a flexible covering. Such a covering, which, by way of example, may consist of a water-impermeable fabric, a thin plastic sheet or the like, is especially low in cost, it has a light weight and it is easily installed.

In a preferred embodiment, the cover is provided in the form of a flat hose-shaped covering which can be pushed over the frame. Of course, the covering may be secured on the frame in other ways, for example by sewing pocket-shaped hems or edges on opposing side edges of the covering, which hems are looped around the profiled rods of the frame.

According to yet another object of the present invention, the cross strip is connected with the free ends of the U-shaped profiled rod by means of corner connectors. Preferably, said corner connectors provide for enhanced stiffening of the U-shaped frames in their lower corner zones.

In a preferred embodiment, the cross strip is provided in the form of a tube. Providing the cross strip in the form of a tube offers the advantage of material and weight savings. In particular when using tubular profiled rods, the cross strips and the free ends of the profiled rods may be connected with each other by means of angle-shaped corner connectors whose legs may be pushed, for example into one end of the cross strip and into one end of the profiled rod, assuring a form-locked connection. If need be, said corner connectors are additionally fixed, for example by means of screws or grooves molded in the tubes.

Preferably, the cross strip provided in the form of a tube is closed at its ends by means of covering caps, so that no water can enter the cross strip, causing, for example, corrosion of the cross strip from the inside.

According to another feature of the invention, a folding joint is arranged on each covering cap, by means of which folding joint the wall section having the covering caps is connected with the adjacent wall section. One of the two folding joints connecting two adjacent frames with each other is advantageously mounted on the covering caps of the cross strips of said frames. The folding joint may be simply mounted in this way by pushing it into the cross strips.

According to another object of the present invention, the cross strip has at its bottom side a receptacle, preferably a slot for receiving therein a sealing lip protruding outwardly from the cross strip. The sealing lip provides in an advantageous manner sealing of the lower edge of the frame against splash water without impairing the pivoting capability of the frame. Of course, sealing lips may be connected in any desired way also with the cross strip.

According to a still further object of the present invention, the wall sections are capable of being folded against each other by means of their folding joints. Advantageously, the folding joints are arranged in such a way that the shower barrier can be folded together like a bellows, which is particularly space-saving.

According to yet another feature of the present invention, sealing elements are arranged on the wall sections for covering the gap between each two adjacent lateral edges. By way of example, the sealing elements may be sealing lips projecting vertically from the profiled rods; the sealing lips may be arranged, for example on the frame or on the splash water protection. For example, strip-shaped straps or strips preferably made of rubber or plastic foil may be used as sealing elements, these elements being stretched or stretching from one lateral edge of a frame to the adjacent lateral edge of another frame. Naturally, a sealing element is provided also for the gap created by the joint connector between the shower barrier and the supporting elements provided on the side of the building. This may be, for example a cover plate of sheet metal with an L-shaped cross section, whose one leg covers the gap whereas its other leg is jointly supported on the support elements on the building side.

According to a final further object of the present invention, the folding joints have stop means for limiting the path of swivel of the wall sections, and the path of swivel is in excess of 180 degrees. Since the path or distance of swivel of the individual wall sections is advantageously greater than 180°, the shower barrier according to the invention may be set up also, for example along a rounded head part of the bathtub.

Other objects and features of the present invention will become apparent from the following detailed description considered in connection with the accompanying drawings. It is to be understood, however, that the drawings are designed as an illustration only and not as a definition of the limits of the invention.

In the drawings wherein similar reference characters denote similar elements throughout the several views.

Figure 1:
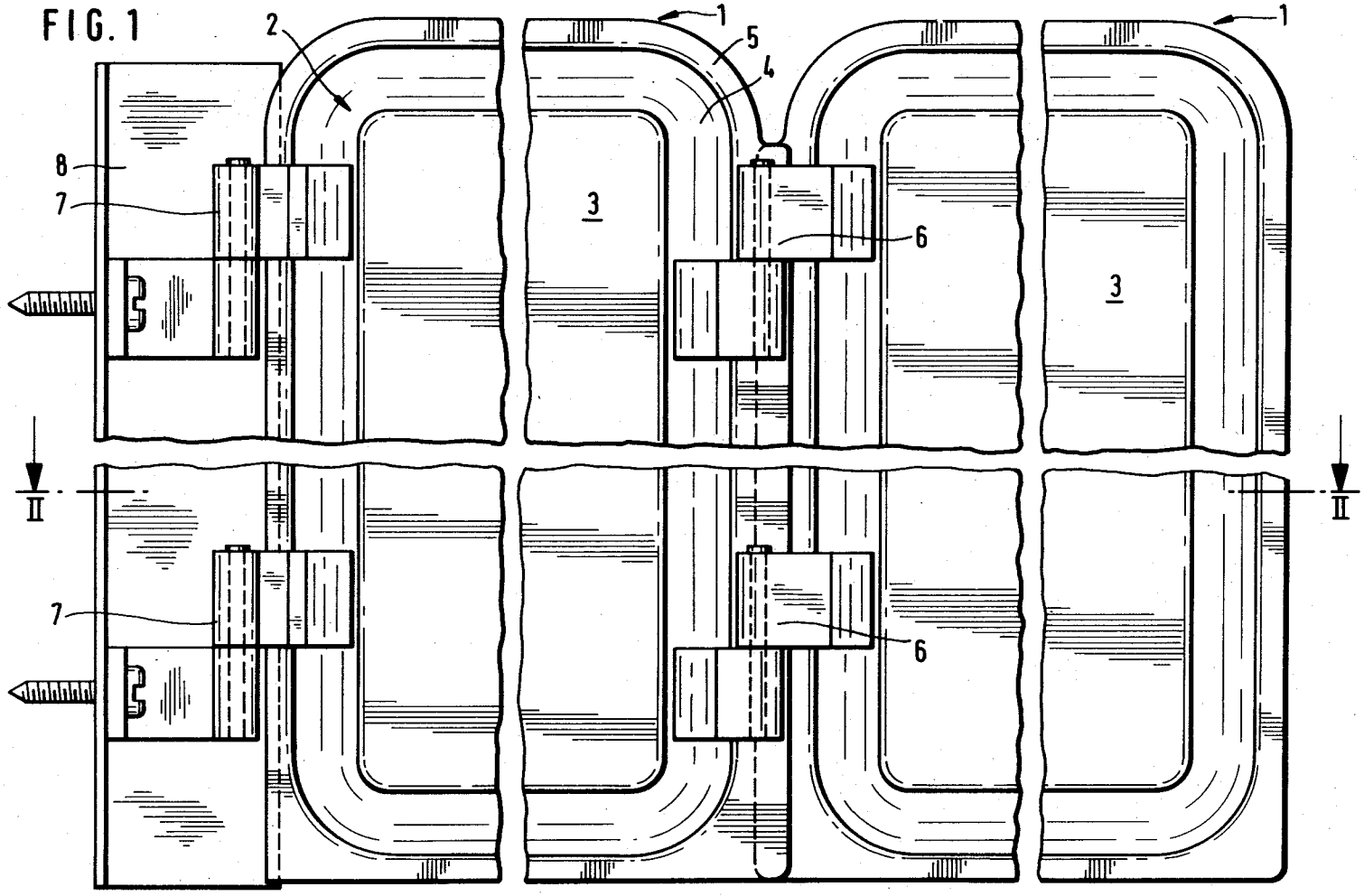
FIG. 1 is a side elevational view of a shower barrier according to the present invention with two wall sections.

Now turning to the drawings, there is shown in FIG. 1 a lateral view of a shower barrier according to the present invention having the two wall sections 1. Each of the wall sections 1 has a frame 2 and a splash water protection which, in the present embodiment, is a plastic board 3. Each of the frames 2 is a closed frame formed by a single bent profiled rod 4, which is a round tube with a relatively thin wall preferably made of aluminum or steel. The holding elements 5 gripping around profiled rod 4 are shaped by molding on plastic board 3.

The two wall sections 1 are connected with each other by means of folding joints 6 and may be folded apart by means of folding joints 6. One of the wall sections 1 is provided on its outer side edge with joint connectors 7, by means of which the shower barrier may be mounted on support elements on the side of the building, for example on the wall of a bathroom. The gap remaining between wall section 1, which has joint connectors 7, and the support elements on the side of the building on which the wall section 1 is mounted, is caused by joint connectors 7 and is covered by means of the angle-shaped covering strip 8.

Figure 2:
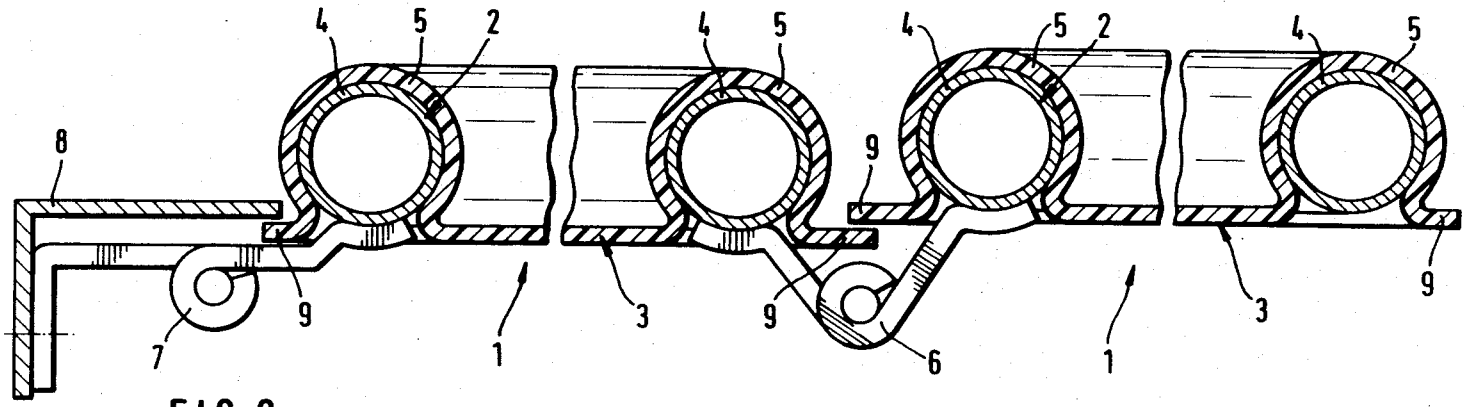
FIG. 2 is a sectional view of the shower barrier of FIG. 1 taken along line II—II of FIG. 1.

In FIG. 2 there is shown a sectional view of the shower barrier according to FIG. 1 taken along the line II—II in FIG. 1, showing the shower barrier in its stretched operating position. Identical components of the barrier are identified by the same reference numerals as in FIG. 1. FIG. 2 shows very clearly the holding elements 5 molded on plastic boards 3, which elements grip around profiled rods 4 of frames 2, each with a degree of about 270°. Holding elements 5 have strap-like sealing elements 9 which, when the shower separation is in its stretched operating position, seal the gaps between adjacent wall sections 1, and the gap between covering strip 8 and wall section 1 having the joint connectors 7.

Figure 3:
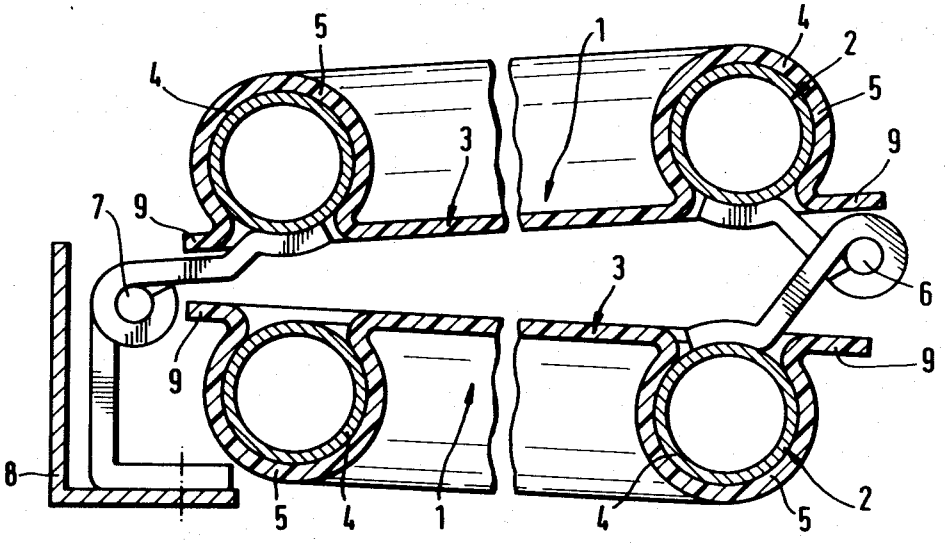
FIG. 3 is a sectional view of the shower barrier according to FIG. 2 shown in the folded state.

In FIG. 3 there is shown the shower barrier according to FIG. 2 in the folded resting position. Again, identical components of the shower barrier are identified by the same reference numerals as used in FIG. 2.

Figure 4:
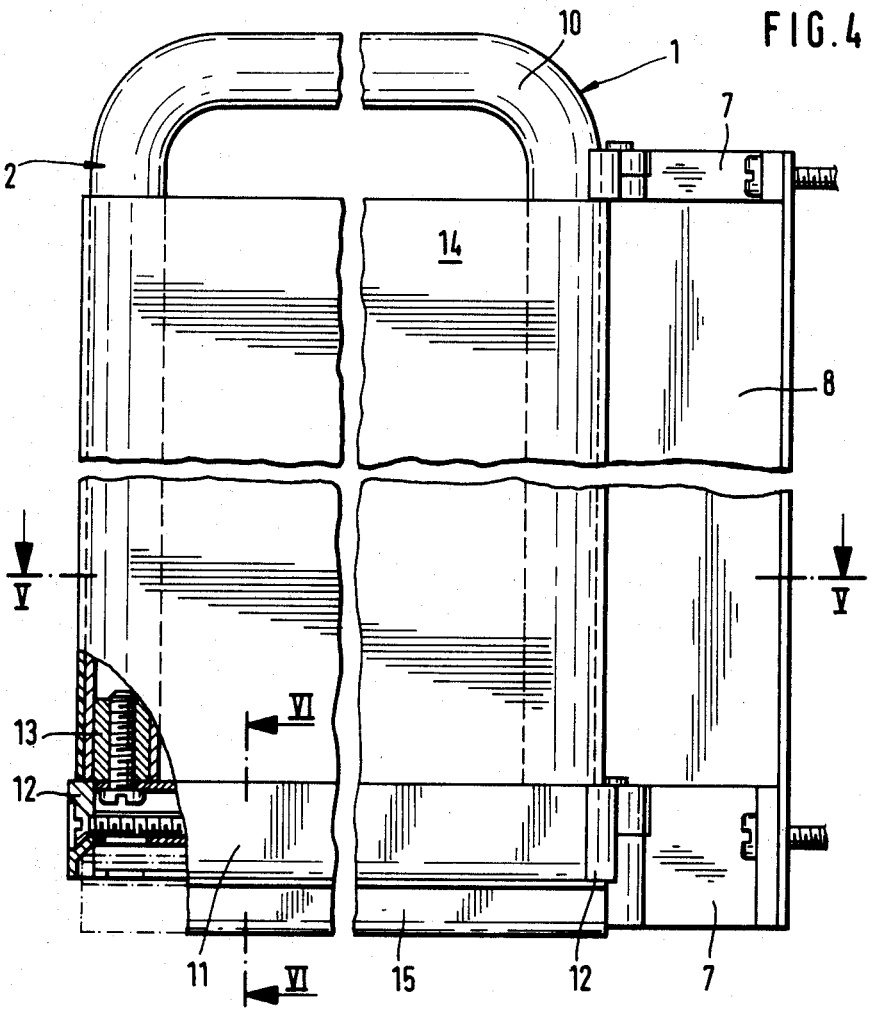
FIG. 4 is a part sectional side elevational view of a shower barrier according to the present invention, with a wall section having a U-shaped profiled tube.

FIG. 4 shows a shower barrier with a wall section 1 shown in a partially cut lateral view. Wall section 1 has a frame 2 formed by a U-shaped, bent profiled rod 10 and a straight tubular cross strip 11. Cross strip 11 is sealed at its ends by covering caps 12 and connected by screwing to the threaded plugs 13, which are pressed into the free ends of the U-shaped profiled rod. At its bottom side, base strip 11 has a sealing lip 15 projecting substantially vertically from the cross strip. Frame 2 has two joint connectors 7, of which one connector is arranged on a covering cap 12 of cross strip 11. By means of these joint connectors, wall section 1 may be mounted on support elements provided on the side of the building. The gap formed on account of joint connectors 7 between wall section 1 and the support elements on the building side is covered by means of a cover strip 8.

A splash water protection is arranged on frame 2 of wall section 1. In the embodiment shown in FIG. 4, this splash water protection is formed by a flexible covering 14 having the shape of a flat tube, which is pushed over frame 2.

Figure 5:
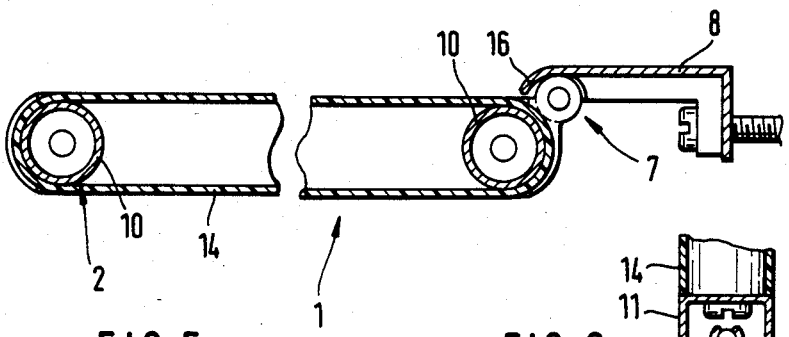
FIG. 5 is a cross-sectional view of the shower barrier of FIG. 4 taken along the line V—V of FIG. 4.

In FIG. 5 a cross-sectional view of the shower barrier of FIG. 4 taken along line V—V of FIG. 4 is shown. Identical components are identified by the same reference numerals as in FIG. 4. FIG. 5 shows with special clarity the flexible covering 14, which has the shape of a flat hose which is pushed over frame 2. It shows, furthermore, that cover strip 8 has a tongue 16 for better sealing of joint connectors 7.

Figure 6:
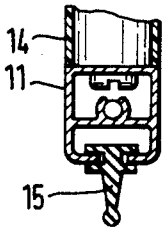
FIG. 6 is a cross-sectional view of the cross strip of the shower barrier of FIG. 4 taken along the line VI—VI of FIG. 1.

FIG. 6 is a cross-sectional view of cross strip 11 taken along line VI—VI of FIG. 4. Again, identical components are identified by the same reference numerals as in FIG. 4. FIG. 6 shows in particular the design of sealing lip 15 projecting approximately vertically from cross strip 11.

Figure 7:
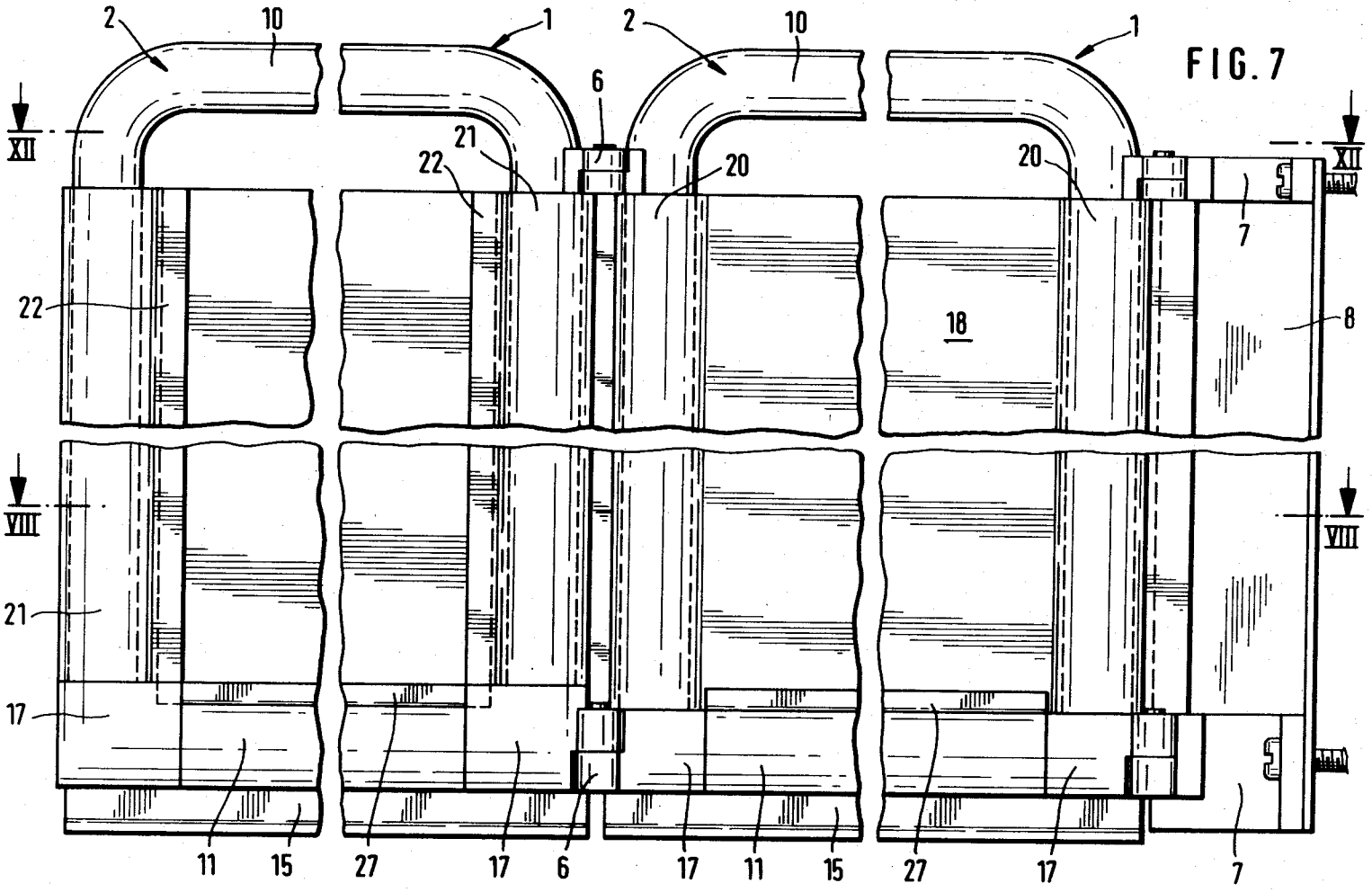
FIG. 7 is a side elevational view of a shower barrier according to FIG. 4 with two wall sections.

In FIG. 7 there is shown a shower barrier comprising two wall sections 1. Wall sections 1 have frames 2, which are formed by the U-shaped, bent profiled rods 10 and the straight cross strips 11. The two wall sections 1 are connected with each other by means of folding joints 6 in such a way that they can be folded against each other. One of the wall sections 1 has the joint connectors 7 by means of which connectors said wall part is mountable on support elements on the side of the building. The gap formed between wall section 1 and the support elements on account of joint connectors 7 is covered by a cover strip 8.

Cross strips 11 are connected with the free ends of the U-shaped, bent profiled rods 10 by means of corner connectors 17. Sealing lips 15 are arranged on cross strips 11, projecting approximately vertically from cross strips 11. Furthermore, the outside fish plates 27 are arranged on cross strips 11 and accommodate between each other a marginal zone of plastic boards 18 and 19.

Each of the frames 2 of wall sections 1 has a splash water protection formed by a plastic board 18, 19. Sleeve-shaped holding elements 20 are molded on one of the plastic boards 18 and grip around U-shaped profiled rod 10. The other plastic board 19 is supported by sleeve pieces 21 which grip around the U-shaped profiled rod 10. Each sleeve piece 21 has outside fish plates 22 projecting approximately radially and accommodating between each other a marginal zone of plastic board 19.

Figure 8:
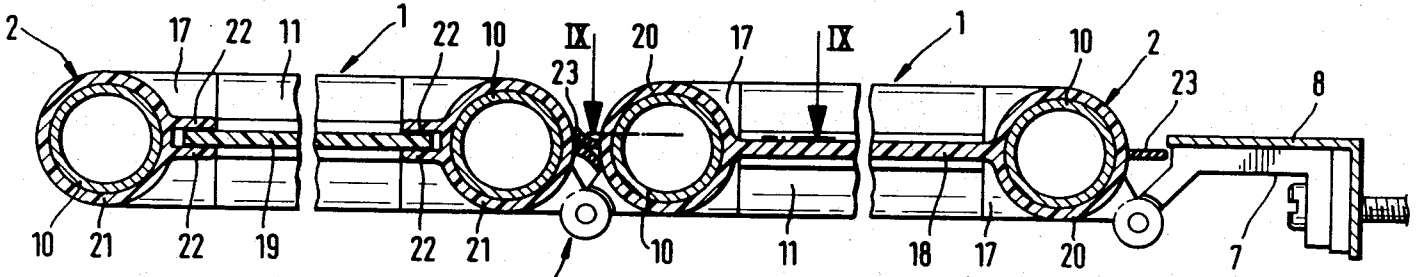
FIG. 8 is a cross-sectional view of the shower barrier of FIG. 7 taken along the line VIII—VIII of FIG. 7.

FIG. 8 shows a cross-sectional view of the shower barrier of FIG. 7 taken along line VIII—VIII of FIG. 7, showing the shower barrier in its stretched operating state. Identical components of the shower barrier are identified by the same reference numerals as in FIG. 7. FIG. 8 especially shows the different holding means for plastic boards 18 and 19. Furthermore, there is clearly shown the fishplate-like sealing elements 22, which seal the gaps between adjacent wall sections 1 and between the wall section 1 supporting joint connectors 7 and the cover strip 8.

Figure 9:
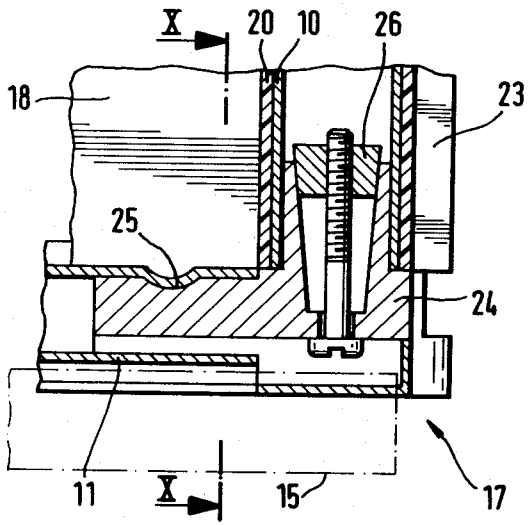
FIG. 9 is a cross-sectional view of a cutout from a corner zone of the shower barrier according to FIG. 7 taken along the line IX—IX in FIG. 8.

FIG. 9 is a cross-sectional view of a cutout showing the corner zone of a wall section 1 taken along line IX—IX of FIG. 8. Identical components are identified by the same reference numerals as in FIG. 8. In FIG. 9, a corner connector 17 is shown which connects cross strip 11 with a free end of U-shaped profiled rod 10. Corner connector 17 has an angle piece 24 which, with its one leg, is inserted in cross strip 11 and with its other leg pushed into the U-shaped profiled rod 10. The leg of the angle piece 24 pushed into cross strip 11 is fixed in the cross strip by means of a groove 25. The other leg of said angle piece 24 has a threaded cone 26 by means of which the outer wall of the leg of angle piece 24 is pressed or forced against the inside wall of U-shaped profiled rod 10. At its bottom edge, cross strip 11 has a sealing lip 15.

Figure 10:
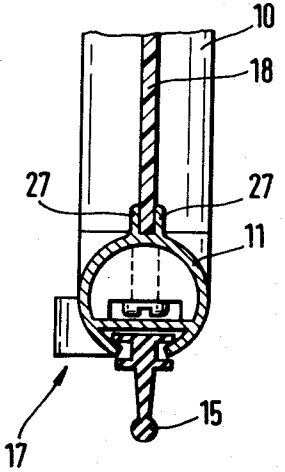
FIG. 10 is a cross-sectional view of a corner zone of a frame according to FIG. 9 taken along the line X—X of FIG. 9.

In FIG. 10 there is shown a cross-sectional view of a corner zone of a wall section 1 according to FIG. 9 taken along line X—X of FIG. 9. Identical components are identified by the same reference numerals as in FIG. 9. FIG. 10 shows in particular the profile of sealing lip 15 as well as outside fishplates 27 which are arranged on cross strip 11 projecting substantially radially from the strip and enclosing or accommodating between each other a marginal zone of the plastic board 18.

Figure 11:
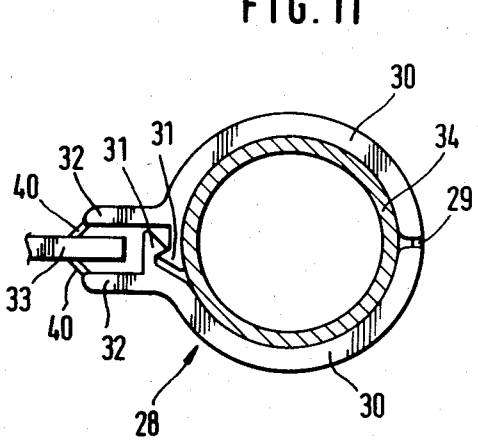
FIG. 11 is a front view of a sleeve piece provided in the form of a holding element.

In FIG. 11 there is shown a sleeve piece 28 having two plastic semi-cups 30, which are connected with each other by means of a weakening joint 29. The free ends of plastic semi-cups 30 are provided with connecting elements 31, which are adapted to lock with each other. The free ends of plastic semi-cups 30 are provided in the form of outer lashings 32, which enclose between each other the marginal zone of a plastic board 33. Sealing elements 40 are arranged on these outer lashings 32 for sealing the intermediate space between the outer lashings against the marginal zone of plastic board 33, ensuring a shock-absorbing support of board 33. The plastic semi-cups 30 grip around a profiled rod 34.

Figure 12:
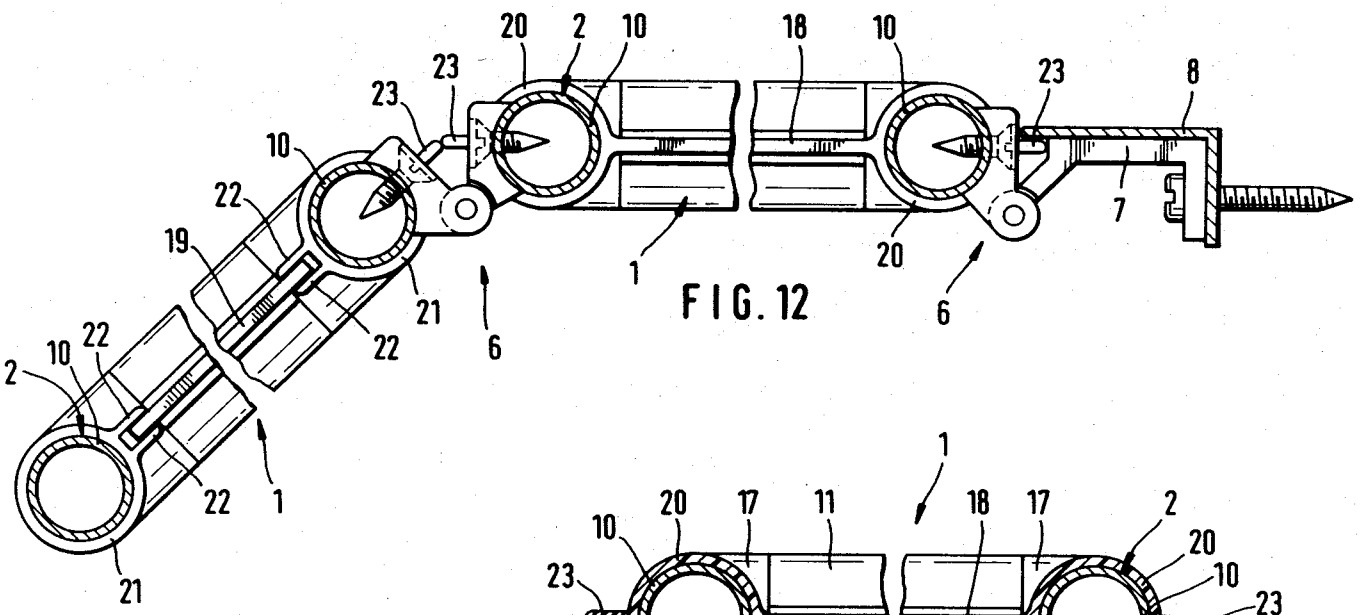
FIG. 12 is a cross-sectional view of a shower barrier as shown in FIG. 8 with the wall sections disposed at an angle to one another.

In FIG. 12 there is shown a top view of a cutout of the shower barrier according to FIG. 7 in a slightly angled operating position, the cutout being defined by lines VIII—VIII and XII—XII of FIG. 7. Identical components are identified by the same reference numerals as used in FIG. 7 and FIG. 8. FIG. 12 especially shows the mode in which sealing elements 23 function.

Figure 13:
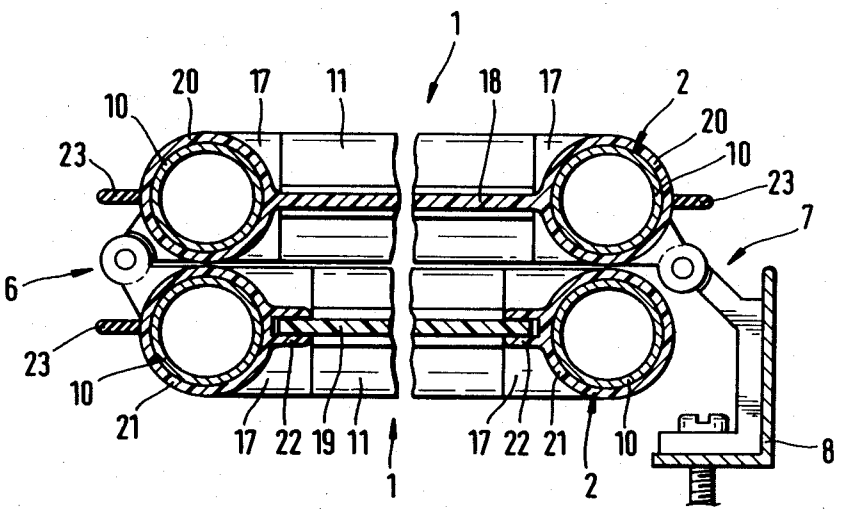
FIG. 13 is a cross-sectional view of a shower barrier as shown in FIG. 12 in the folded condition.

FIG. 13 shows the shower barrier according to FIG. 8 in the folded resting position. Identical components are identified by the same reference numerals as used in FIG. 8. FIG. 13 especially shows the space-saving way in which the shower barrier can be folded together.

Figures 14, 15:
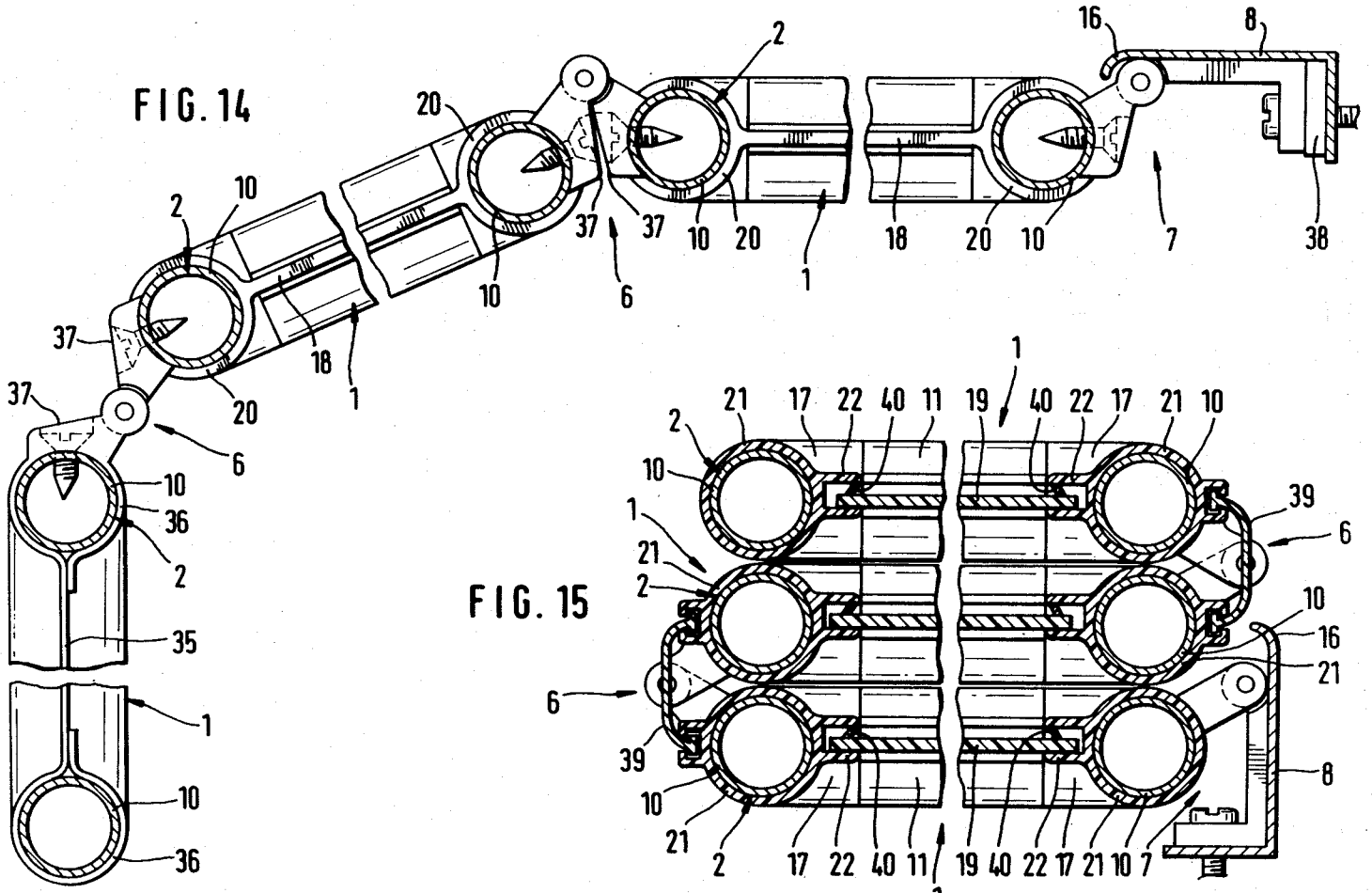
FIG. 14 is a cross-sectional view of a shower barrier according to the present invention with three wall sections.
FIG. 15 is a cross-sectional view of a shower barrier according to the present invention with three wall sections folded like a bellows.

In FIG. 14 there is shown a horizontal sectional view of a shower barrier comprising three wall sections 1. Wall sections 1 have frames 2 formed by profiled rods 10 bent in the shape of a "U". The frames are open on the one side at the bottom. Serving as the splash water protection two of said frames 2 support plastic panels 18 with the holding elements 20 molded on said panels in the shape of sleeves, whereas the third frame 2 has a flexible covering 35 serving as splash water protection. Covering 35 grips around U-shaped profiled rod 10 with the pocket-like hems 36 arranged on the opposing lateral edges.

The three wall sections 1 are connected with each other by means of folding joints 6 in such a way that they can be folded against each other. Folding joints 6 have stop means 37 for limiting the path or distance of pivoting of wall sections 1. The stop means are bevelled in such a way that the path or distance of swivel of each wall section 1 exceeds 180 degrees. Joint connectors 7 are arranged on one of the wall sections 1 so that the shower barrier can be mounted on support elements provided on the building side. The gap between the support elements on the building side and the wall section 1 supporting joint connectors 7 is covered by a cover strip 8 having a tongue 16 for superior sealing efficiency. A compensating piece 38 is disposed between joint connectors 7 and cover strip 8, by means of which inclined surfaces, for example inclined parts of the wall of a bathroom, can be compensated for.

In FIG. 15 there is shown a horizontal sectional view of a shower barrier with three wall sections 1 in the folded resting position. Identical components are identified by the same reference numerals as used in the preceding figures. All three wall sections 1 have plastic boards 19 serving as splash water protection which are supported by sleeve pieces 21 with the outer lashings 22. The sleeve pieces grip around profiled rods 10 of frames 2. The outside lashings 22 are provided with sealing elements 40, which seal the outside lashings against plastic boards 19 and ensure a shock-absorbing support of plastic boards 19 between the outside lashings 22. The gaps between each two adjacent wall sections 1 are sealed by means of fishplate-like sealing elements 39 extending stretched between adjacent lateral edges of the frames 2.

While several embodiments of the present invention have been shown and described, it will be obvious that many further changes and modifications may be made thereunto without departing from the spirit and scope of the invention.

What is claimed is:

1. A shower barrier comprising at least two substantially rectangular wall sections hingedly attached to each other, each having top, bottom and side edges delimited by a rectangular frame and having a plastic board for splash water protection, the peripheral edges of said frame being formed by a one piece profiled tubular shaped member and said frame supporting said plastic board, said board including holding elements consisting of integral sleeve pieces extending around the periphery gripping around the profiled tubular shaped member, each holding element having at least along each side edge substantially laterally projecting outer flanges adapted to overlap adjacent flanges of adjacent wall sections.

2. The shower barrier as defined in claim 1, wherein all of the lateral edges of said frame are formed by a single profiled tubular shaped member.

3. The shower barrier as defined in claim 1, wherein three lateral edges of said frame are formed by a single U-shaped profiled tubular shaped member.

4. The shower barrier as defined in claim 3, wherein the free ends of the U-shaped profiled tubular shaped member are connected by means of a straight cross strip.

5. The shower barrier as defined in claim 1, wherein the cross-section of the profiled tubular shaped member is in the form of a tube.

6. The shower barrier as defined in claim 1, wherein a plurality of wall sections are provided and wherein adjacent lateral edges of said wall sections are provided with folding joints connecting said wall sections, and one wall end section of said plurality of wall sections has joint connectors mounted on its free lateral edge on support elements on a side of a building.

7. The shower barrier as defined in claim 6, wherein said plurality of wall sections are foldable against each other by means of folding joints.

8. The shower barrier as defined in claim 6, wherein sealing elements are arranged on said wall sections covering the gap between each two adjacent lateral edges thereof.

9. The shower barrier as defined in claim 7, wherein said folding joints have stop means limiting the distance of pivoting of the wall sections, said limit being greater than 180 degrees to permit movement from a position wherein adjacent wall sections are aligned in the same plane to a position wherein adjacent wall sections are folded on one another.

10. The shower barrier as defined in claim 1, wherein each sleeve piece is comprised of two plastic semi-cups, said semi-cups being connected with each other by means of a weakening joint and having connecting elements on their free ends averted from said weakening joint which are releasably lockable with each other.

11. The shower barrier as defined in claim 1, wherein the surfaces of the outer flanges facing each other are provided with sealing elements.

12. A shower barrier comprising at least two substantially rectangular wall sections delimited by a frame and having a plane splash water protector arranged on said frame, three lateral edges of said frame being formed by a single U-shaped profiled tubular shaped member the free ends of which being connected by means of a straight cross strip in the form of a tube closed at its ends by covering caps, and a folding joint arranged on each covering cap interconnecting said at least one wall section with an adjacent wall section.

13. The shower barrier as defined in claim 12, wherein said cross strip is connected with the free ends of said U-shaped profiled tubular shaped member by means of corner connectors.

14. The shower barrier as defined in claim 12, wherein said cross strip has on its bottom side a receptacle in the form of a slot for a sealing lip projecting outwardly from said cross strip.

* * * * *